United States Patent [19]

Jenkins

[11] Patent Number: 4,798,379

[45] Date of Patent: Jan. 17, 1989

[54] EXERCISE MACHINE

[75] Inventor: John W. Jenkins, Hampton, Ga.

[73] Assignee: Bellwether, Inc., Atlanta, Ga.

[21] Appl. No.: 82,742

[22] Filed: Aug. 7, 1987

[51] Int. Cl.[4] ..... A63B 21/00; A63B 1/00

[52] U.S. Cl. ..... 272/73; 272/70; 272/132

[58] Field of Search ..... 272/70, 73, 72, 97, 272/132, 96, 69, 93; 128/25 R, 25 B

[56] References Cited

U.S. PATENT DOCUMENTS

| | | | |
|---|---|---|---|
| 3,262,247 | 9/1885 | Root | 272/73 |
| 3,501,142 | 3/1970 | Johansson | 272/73 |
| 3,704,886 | 12/1972 | Kay et al. | 272/132 |
| 3,833,216 | 9/1974 | Philbin | 272/73 |
| 4,188,030 | 2/1980 | Hooper | 272/73 |
| 4,537,396 | 8/1985 | Hooper | 272/72 |
| 4,563,001 | 1/1986 | Terauds | 272/130 |
| 4,643,418 | 2/1987 | Bart | 272/69 |
| 4,679,786 | 7/1987 | Rodgers | 272/70 |
| 4,708,128 | 11/1987 | Ancillotti | 272/73 |
| 4,720,093 | 1/1988 | Delmar | 272/70 |

FOREIGN PATENT DOCUMENTS

| | | | |
|---|---|---|---|
| 2428515 | 1/1976 | Fed. Rep. of Germany | 272/73 |

OTHER PUBLICATIONS

Scientific American, Mar. 1987, p. 85.

*Primary Examiner*—Richard J. Apley
*Assistant Examiner*—S. R. Crow
*Attorney, Agent, or Firm*—Jones, Askew & Lunsford

[57] ABSTRACT

An exercise machine in the nature of a stationary cycle exerciser. The exercise machine replaces the conventional crank-arm rotary pedal drive with reciprocating treadles or pedals connected to drive a work-utilizing device at a substantially uniform rate throughout the entire input stroke by the user. Hand-operated levers are also provided for manipulation by the user, and movement of these levers is coupled to the working load. The hand levers are operatively interconnected to the treadles for simultaneous movement.

3 Claims, 10 Drawing Sheets

EXERCISE MACHINE

FIELD OF INVENTION

This invention relates in general to exercise machines, and relates in particular to stationary cycle exercisers.

BACKGROUND OF THE INVENTION

Cycle exercise machines, sometimes also known as "stationary bicycles", have been known for some time. These exercise machines typically include a seat much like a bicycle seat, for supporting a person sitting upright on the machine, and a foot-powered crank arrangement mounted below the seat. This crank arrangement in prior-art cycle exercisers includes a pair of crank arms extending outwardly from a rotatable shaft, with foot pedals mounted at the free ends of the crank arms. The crank arrangement is mounted for receiving the feet of a person seated on the exercise machine. A drive chain or belt transfers the rotary motion of the crank arrangement to an energy-absorbing device such as a flywheel or rotor, which provides a load force against which the exerciser expends energy while pedaling the crank mechanism. One such cycle exerciser is disclosed in U.S. Pat. No. 4,188,030 to Hooper.

Because cycle exercisers of the prior art use a crank mechanism which the user pedals while doing work on the machine, these exercise machines cannot provide a constant transfer of power from the user to the load throughout the entire stroke of each pedal. Crank pedal mechanisms have a null at the top and bottom of each stroke, where the effective length of the pedal crank arms diminishes to zero length as the crank mechanism passes through the dead center position. The effective lever arm of the pedals then increases sinusoidally to the maximum effective length as the pedal crank arms pass through the 90° position, i.e., half-way between the top to the bottom of each stroke. Because this effective lever arm constantly changes, the rate at which the exerciser can effectively expend energy doing work on the load device likewise changes throughout each stroke of the pedal. This variation lessens the possible maximum efficiency of cycle exercisers, as the rate of energy transfer for each stroke is maximized only momentarily during each stroke.

Another disadvantage of existing cycle exercisers, and in particular the crank mechanism used with those exercisers, pertains to the length of stroke. The stroke length is determined by the length of the crank arms used in the crank mechanism, and this length is not readily changeable. Changing the effective stroke length requires either replacing the entire crank assembly, or providing crank arms having variable positions for attaching the pedals on the crank arms. In either case, these alternatives are expensive and require the service of a technician to modify the length of the crank arms for users having significantly different lengths of stroke, namely, shorter or longer legs, or those of substantially different athletic ability.

SUMMARY OF THE INVENTION

Accordingly, it is an object of the present invention to provide an improved cycle exercise machine.

It is another object of the present invention to provide a cycle exercise machine which does not require a conventional rotary crank arrangement.

It is yet another object of the present invention to provide an exercise machine wherein the rate of energy transfer by the exerciser is substantially constant throughout each stroke.

It is a further object of the present invention to provide a cycle exercise machine in which the length of each stroke by the exerciser may be shortened without affecting the structure or utility of the machine.

Other objects and advantages of the present invention will become more apparent from the following description.

Stated in general terms, the present invention utilizes a pair of foot-operated treadles or pedals in place of the rotary pedal arrangement found in conventional exercise machines. These treadles receive the operating force of the user in back-and-forth fashion as the user's feet alternately press the treadles, and couple that back-and-forth movement to an energy absorbing device for applying a mechanical load to the treadles, and for dissipating the energy expended in moving the treadles. A pair of hand-operated levers is also coupled to the energy dissipating device.

Stated somewhat more specifically, each foot treadle is reciprocable along a path, and the treadles are coupled together so that depressing one treadle automatically raises the other treadle, and vice versa. The treadles are mounted either for movement along an arcuate path, or alternatively are mounted for movement along a linear path. The reciprocating movement is coupled to drive a load dissipating mechanism, preferably a rotary device as disclosed below.

Stated with greater specificity, the treadles are interconnected by a flexible tension element which passes over a pulley arrangement for reversing the direction of web travel attached to each treadle. The treadle-driven tension element also drives at least one one-way clutch, which in turn drives a rotor when the treadle-driven tension element moves in a particular direction. The one-way clutch freewheels during the return movement or stroke of the treadle, allowing the rotor to continue turning without affecting the return movement of that treadle. The entire downward stroke of each treadle is useful in expending energy at a substantially constant rate, because the treadle arrangement lacks the null zone associated with the dead-center position of the conventional crank arm arrangement.

The load device driven by the treadle mechanism can be of any suitable kind. One such load device is a flywheel equipped with radial vanes pitched to cause maximum drag as the vaned wheel rotates in response to movement of the treadles. An alternative arrangement is a rotor peripherally engaged by a friction brake device. The brake device may incorporate a torque sensor for measuring and transmitting a signal corresponding to foot-pounds of torque applied to the rotor.

DETAILED DESCRIPTION OF PREFERRED EMBODIMENTS

Figure 1:
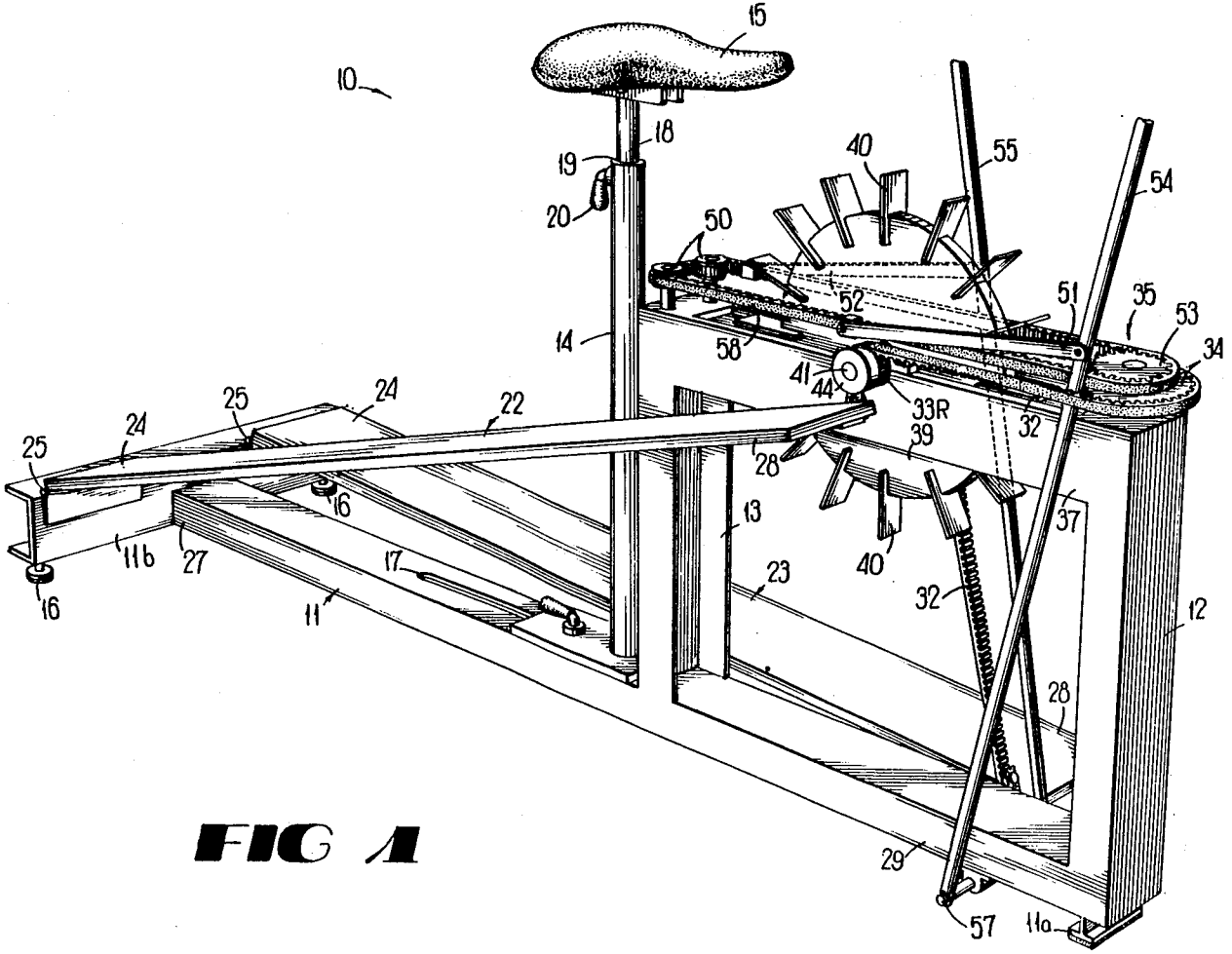
FIG. 1 shows a pictorial view of an exercise machine according to a first embodiment of the present invention, with certain parts omitted for clarity of illustration.

Turning first to FIG. 1, there is shown generally at 10 an exercise machine according to a first embodiment of the present invention. This exercise machine 10 includes a support frame having a base 11 suitable for support on a floor surface, and a pair of upright members 12 and 13 extending upwardly from the front and from an intermediate location on the base. The base 11 is attached to a plate 11*a* at the front which rests on a floor, and to a back plate 11*b* supporting a pair of adjustable leveling feet 16 which engage the floor. The front plate 11*a* and feet 16 support the base 11 slightly elevated above the floor. A seat support pedestal 14 extends upwardly from the base 11, at a location behind the intermediate upright member 13. The seat support pedestal 14 is thus considered as being behind the upright members 12 and 13. The seat support pedestal is preferably adjustable in the base slot 17 over a front-to-back range of movement.

A seat 15 is supported at the upper end of the seat support pedestal 14. This seat 15 supports the user of the exercise machine 10, and the seat in the present embodiment has the general shape and nature of a conventional bicycle seat or the like. To accommodate exercisers of differing heights and leg lengths, the seat 15 is vertically adjustable with respect to the base 11, and in the disclosed embodiment this adjustment is provided by the post 18 telescopically received in the hollow upper end 19 of the seat support pedestal 14. The desired vertical adjustment of the post 18 at the upper end 19 is maintained by any suitable device such as a screw clamp 20, as is known in the art of mounting bicycle seats or the like.

A pair of foot treadles 22 and 23 is attached to the base 11, with each treadle flanking the opposite outer sides of the seat support pedestal 14 and the upright member 13. Each treadle 22 and 23 is sufficiently wide to readily accommodate a foot of a person occupying the seat 15; treadle widths on the order of 4–5 inches are appropriate, although by no means limiting. The treadles 22 and 23 at their back ends 24 are connected to corresponding hinges 25 adjacent the back end 27 of the exercise machine base 11. Each treadle 22 and 23 extends forwardly from its respective hinge 25, terminating at a forward end 28 near the forward end 29 of the base 11, in the disclosed embodiment.

The two treadles 22 and 23 are interconnected so that one treadle rises when the other treadle is depressed downwardly, and vice versa. This alternative reciprocable movement of the treadles 22 and 23 is provided by the main drive belt 32, the ends of which are connected to each treadle at a point adjacent to the forward end 28 of the treadles. The main drive belt 32 is a toothed belt in the disclosed embodiment, and extends upwardly from one treadle 22 to pass over the toothed pulley 33R, and thence extends forwardly to engage the lower toothed pulley 34 of the timing pulley stack 35. The pulley 34 is connected to the upper toothed pulley 53 of the timing stack 35, as described below. The stacked pulleys 34 and 53 rotate together on an upright support shaft. The main drive belt turns approximately 180° around the pulley 34 and from there moves back to engage the toothed pulley 33L (FIG. 3) and turn downwardly for connection to the left treadle 23. It should now be understood that as a person using the exercise machine 10 presses downwardly on one treadle, that downward movement is translated to upward movement of the other treadle by the main drive belt 32 acting around the pulleys 33R, 34, and 33L.

A horizontal support 37 extends between the upper ends of the upright members 12 and 13, and the horizontal support mounts a vertical flywheel 39 entirely enclosed within the safety housing 35 (omitted in FIG. 1). A number of radial vanes 40 extend on the flywheel 39, and these rotor vanes have substantial frontal area on a plane transverse to the vertical plane of the rotor. These rotor vanes 40 dissipate energy to the air as the rotor 39 turns, as pointed out below in greater detail.

The rotor 39 is attached to an axial shaft 41, and the two ends of the shaft are received in the corresponding output elements of two free-wheeling clutches 44 and 45, also commonly known as one-way clutches. These clutches 44 and 45 each have an input element to which the respective pulleys 33R and 33L are attached. With free-wheeling clutches of this type, the input element is rotatable in either direction by a driving force, but the clutch transmits force to the output element in response only to input rotation in one direction. When that input force ceases or reverses, the input element simply free-wheels with respect to the output element. Details of such clutches are well known and thus are not repeated herein.

A pair of exercise levers 54 and 55, intended for exercising the arms and shoulders of a user on the seat 15, are pivotably attached adjacent the forward end of the base 11. These exercise levers 54 and 55 extend upwardly from a pivot bar 57 at the base 11, passing within the forward runs of the drive belt 32 and terminating at their upper ends in horizontal handles 56 (FIG. 2) extending outwardly from the exercise levers and designed for grasping by the user. The handles thus are reciprocable in push-pull fashion along a predetermined maximum arc of movement. The pivot bar 57 can be mounted for an extent of backward and forward movement along the base 11, thereby selectively varying the position of the handles 56 relative to the seat 15.

The exercise handles 54 and 55 are connected to respective links 51 and 52, which attach to the hand lever toothed drive belt 58. This drive belt passes over the idler pulleys 50 mounted on posts extending above the back end of the horizontal support 37, and extends forwardly on both sides of the rotor 39 to engage the upper toothed pulley 53 of the previously-discussed timing pulley stack 35. The upper pulley 53 and the lower pulley 34 of the stack 35 are interconnected, so that rotation of the lower pulley by the main drive belt 32 drives the upper pulley and the handle drive belt 58, and vice versa.

Figure 2:
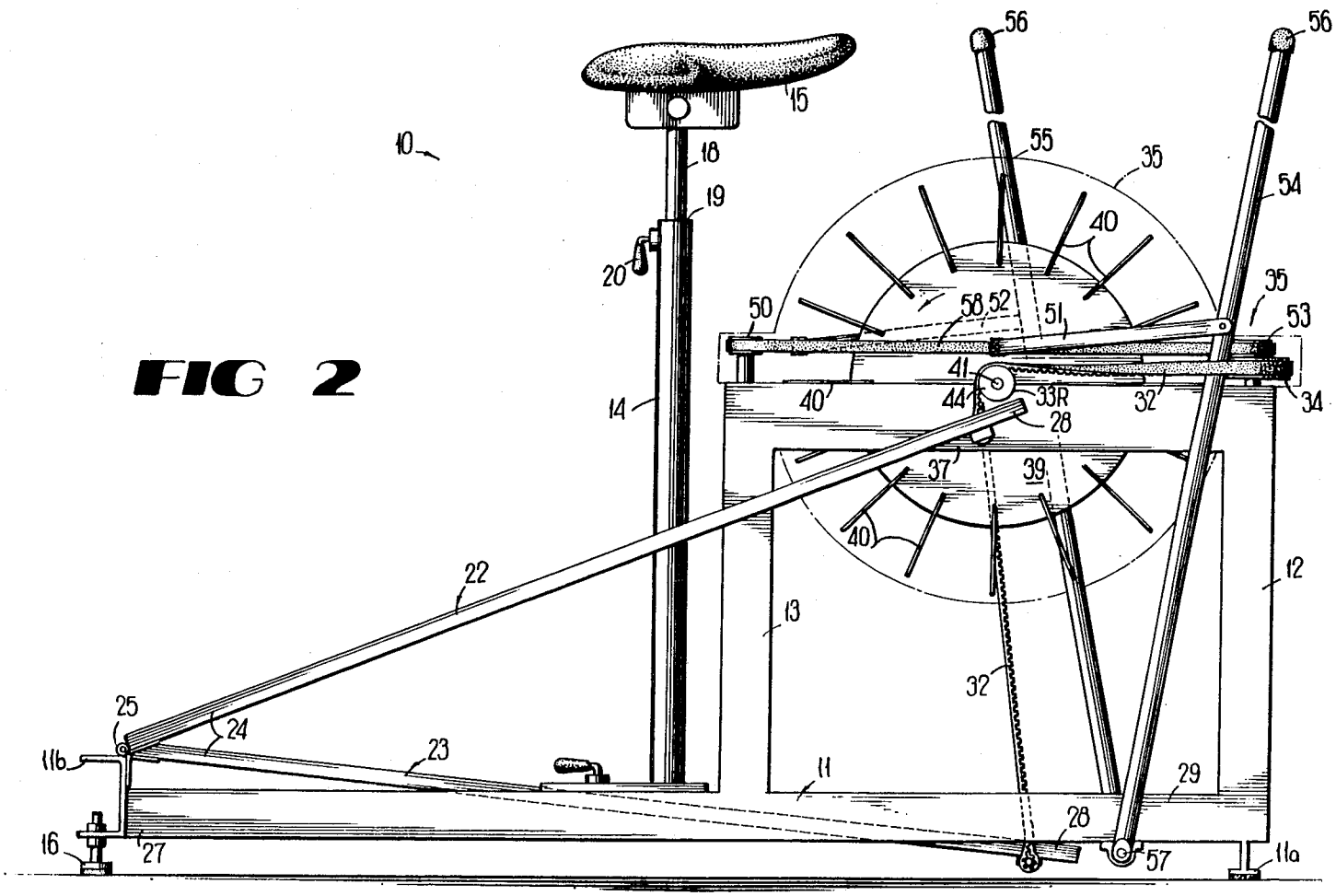
FIG. 2 shows a side elevation view taken from the right side of FIG. 1.
Figure 3:
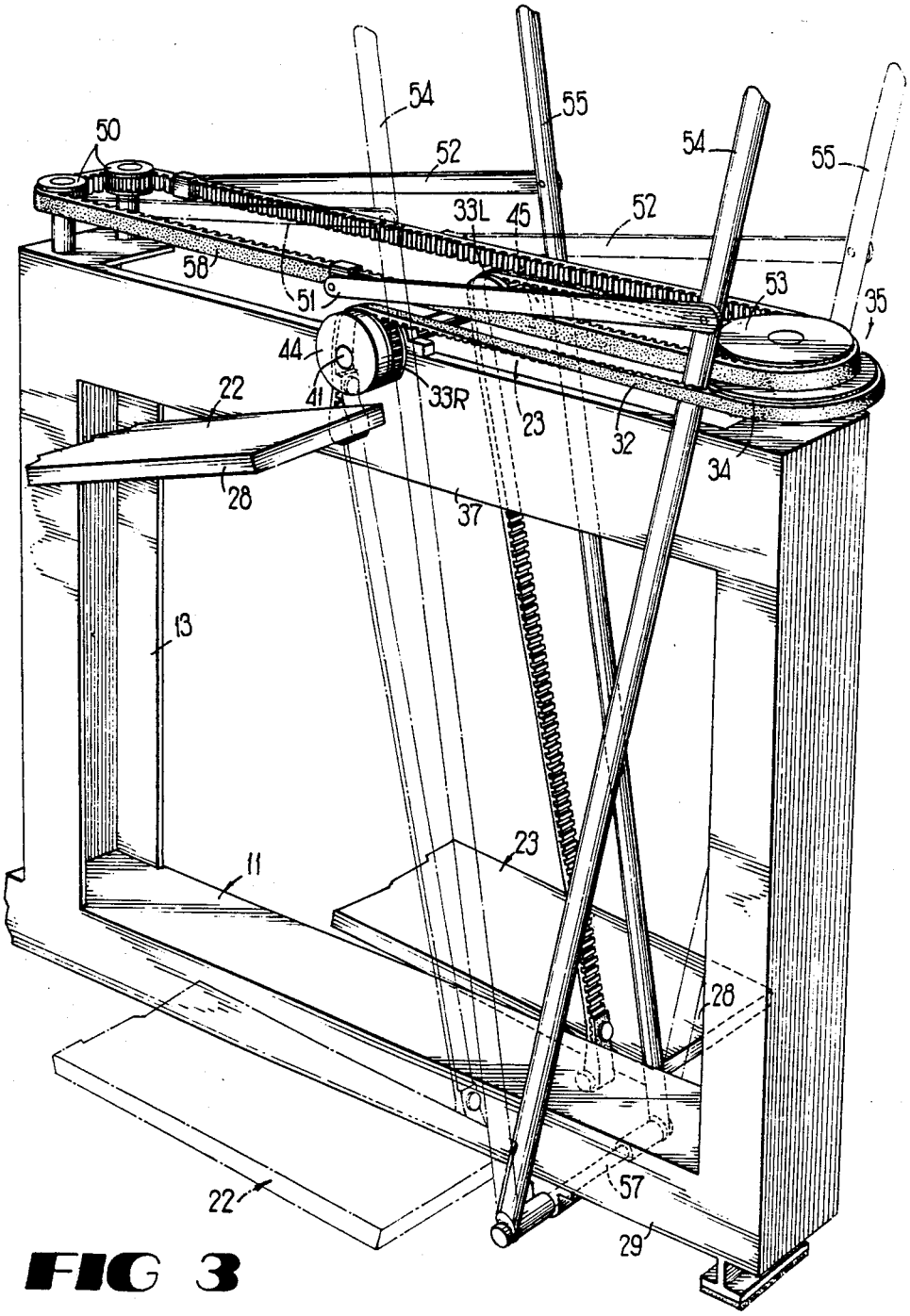
FIG. 3 is a fragmentary pictorial view showing the drive mechanism of the embodiment shown in FIGS. 1 and 2.

The operation of the exercise machine as thus described in FIGS. 1–3 is now considered. A user sits on the seat 15 after the height of the seat post 18 is suitably adjusted, and the user's feet rest naturally on the two foot treadles 22 and 23. If desired, the user also grasps the handles 56 of the two exercise levers 54 and 55. The user now depresses first one foot treadle 22 and then the other treadle 23, with an alternating up-down reciprocating movement of the foot treadles. The main drive belt 32, interconnecting the foot treadles 22 and 23 across the toothed pulley 33R, the lower toothed pulley 34, and the toothed pulley 33L, insures that depressing one foot treadle simultaneously raises the other foot treadle in a linked up-down reciprocating fashion.

Each downward stroke of either foot treadle imparts rotary motion to the flywheel 39 as the main drive belt 32 and the pulleys 33R, 33L drive the one-way clutches 44. During the upward movement of each foot treadle, for example, treadle 22, the main drive belt 32 drives the pulley 33R while the one-way clutch 44 allows clockwise movement (as seen in FIG. 1) of the pulley without interfering with the counterclockwise rotation of the flywheel 39 powered by the previous downward movement of the other foot treadle 23.

Each time one of the foot treadles 22 and 23 is depressed, this action also forces the exercise levers 54 and 55 to change positions along their arcs of travel. For example, as the foot treadle 22 moves downwardly and the main drive belt 32 turns the lower toothed pulley 34, the upper toothed pulley 53 pulls the hand lever drive belt 58 in the same direction as the main drive belt. This movement of the drive belt 58, coupled through the links 51 and 52, pulls the exercise lever 54 back toward the user and pushes the other exercise lever 55 forwardly away from the user. Subsequent downward movement of the other foot treadle 23 reverses the foregoing reciprocable movement of the exercise levers 54 and 55, returning those levers to the position shown in FIG. 1. Likewise, the user can alternatively push and pull the levers 54 and 55, and that effort is transmitted to the main drive belt 32 to drive the flywheel 39.

The entire downward stroke of each foot treadle 22 and 23 applies force at substantially the same rate to rotate the flywheel 39, as the main drive belt 32 acts on the toothed pulleys 33R and 33L at a constant lever arm, namely, the radius of each toothed pulley. This constant application of work to drive the flywheel 39 contrasts with the pedaling action of a typical exercise cycle having a bicycle crank arrangement, with a null or dead zone at the top and bottom of each pedal stroke. The belt drive arrangement of the present exercise machine avoids these null zones, and the user does work (and expends energy) throughout each depression of the foot treadles.

The same constant-force function also applies to the exercise levers 54 and 55, to the extent the user pulls or pushes the levers during the stroke of each lever. The effective mechanical advantage through which each lever applies work to the flywheel 39 is decreased by the smaller radius of the upper pulley 53 relative to the lower pulley 34.

Figure 4:
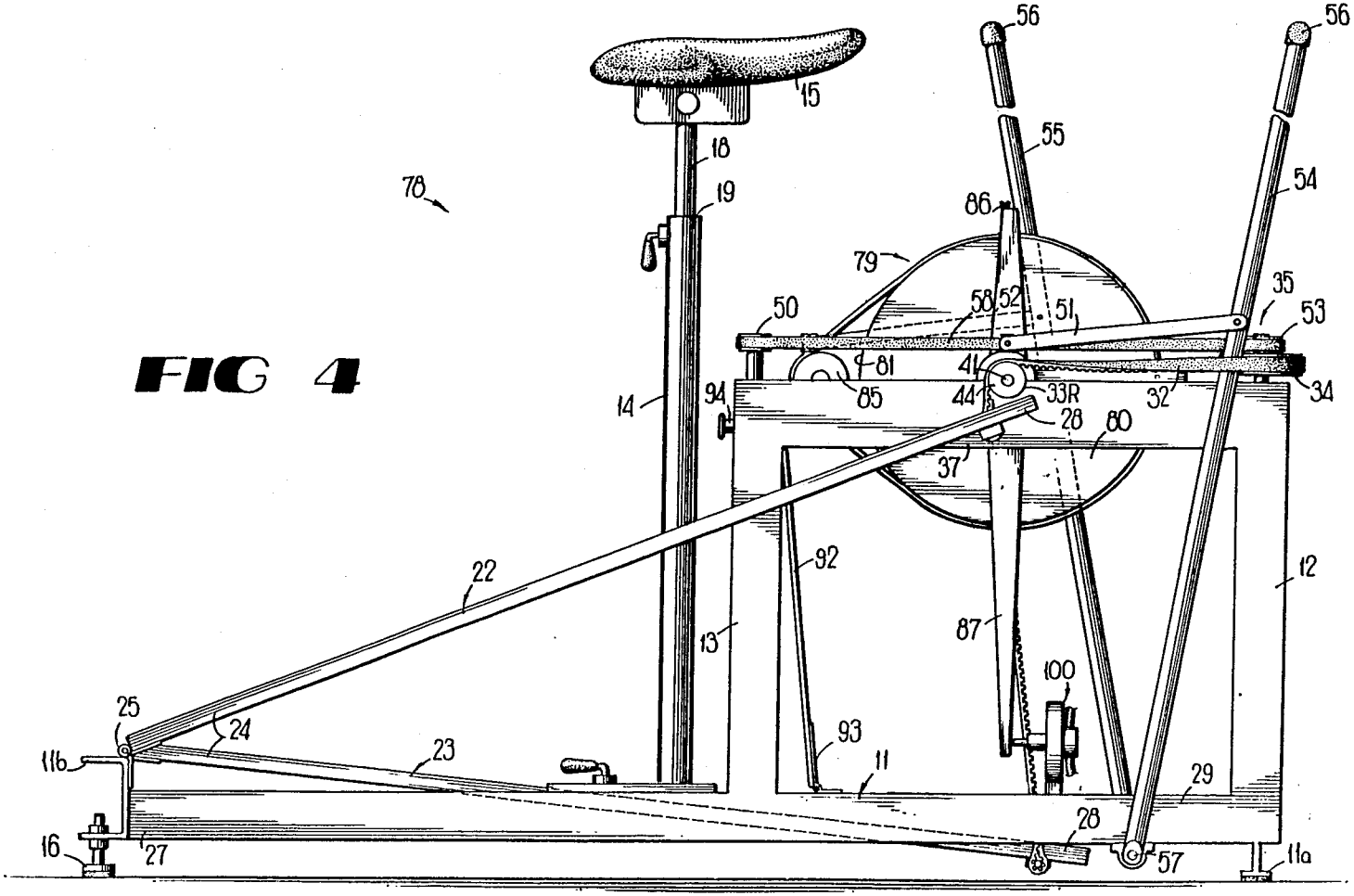
FIG. 4 is a partial side elevation view showing a second embodiment of the present invention.
Figure 6:
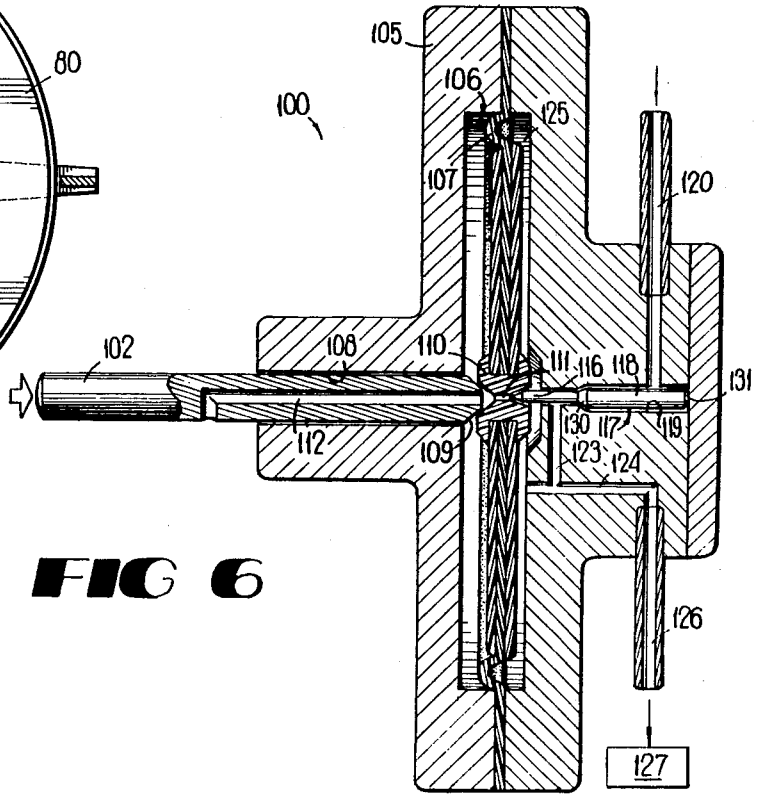
FIG. 6 is an enlarged section view showing the force transducer used in the embodiment of FIGS. 4 and 5.
Figure 5:
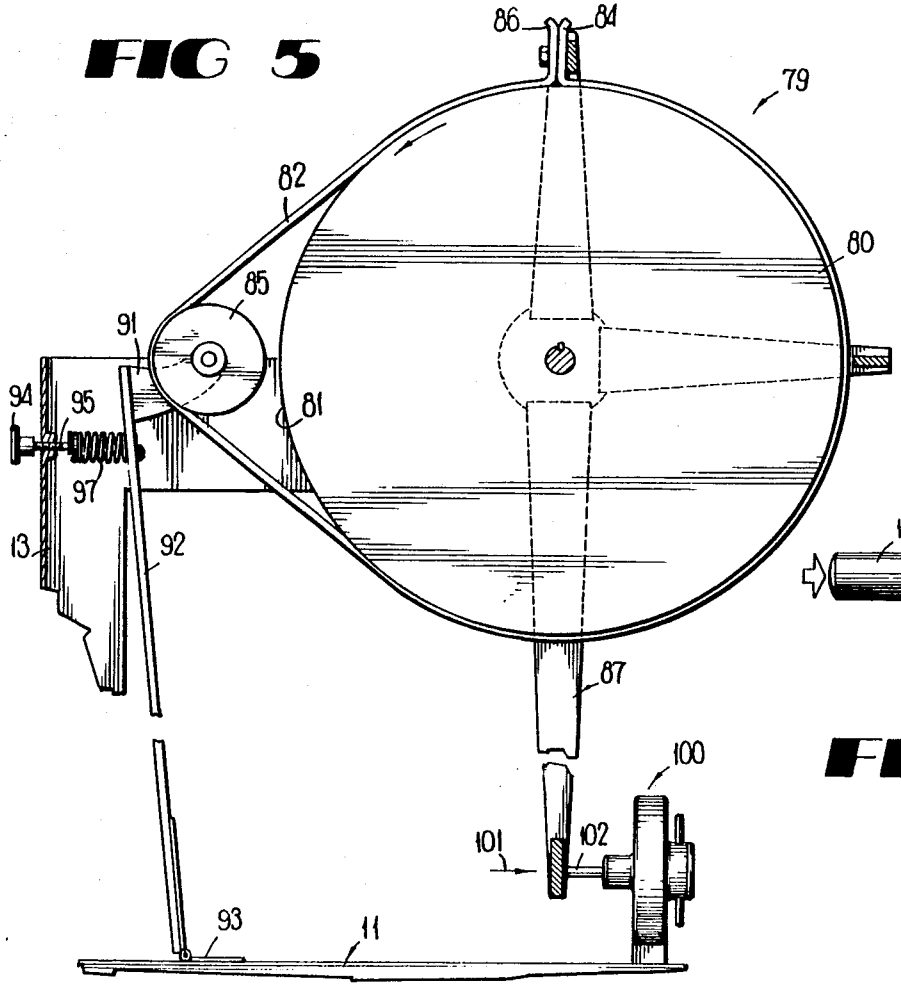
FIG. 5 is a detail elevation view of the brake band mechanism in the embodiment of FIG. 4.

FIGS. 4–6 show another exercise machine 78 using the same treadle and drive belt mechanism as in the exercise machine 10, and using the same numerals to identify elements in common with the preceding embodiment. The exercise machine 78 substitutes a frictional brake band mechanism 79 for the flywheel 39 and rotor vanes 40 of the first embodiment, for an energy-absorbing mechanism driven by the treadles 22, 23 and the exercise levers 54, 55.

The brake band mechanism 79 includes a flywheel 80 having a smooth outer peripheral surface 81, preferably slightly channelized to engage and retain the sides of the brake band 82 which engages the peripheral surface. The flywheel 80 should be sufficiently heavy to stabilize variations in torque applied through the treadles and exercise levers.

The brake band 82 wraps around the flywheel 80, and around the relatively small torque loading pulley 85 supported behind the flywheel at the upper end of the upright member 13. The brake band 82 is connected neither to the flywheel 80 nor to the torque loading pulley 85, in the disclosed embodiment. Instead, both ends 84 and 86 of the brake band 82 are fastened to the upper end of the torque frame 87 at a point above the flywheel 80. The torque frame 87 is further described below. As will become apparent, the torque loading pulley 85 and the brake band 82 undergo minimal movement.

The torque loading pulley 85 is mounted on the bracket 91 at the upper end of the tension lever 92 extending upwardly from the hinge 93 fastened to the frame 11 immediately in front of the upright member 13. A torque load adjusting knob 94 on the back side of the upright member 13 engages the threaded stud 95 extending through that upright member, and a torque tension spring 97 interconnects the stud to the tension lever 92. Manual adjustment of the knob 94 thus increases the amount of spring tension urging rearwardly the bracket 91 at the upper end of the tension lever 92 and the torque loading pulley 85 carried by that bracket.

The torque frame 87 restrains the brake band 82 from angular and sideways movement on the flywheel 80, and transmits torque to the torque sensor 100 mounted on the base 11 near the lower end of the torque frame. The torque frame 87 extends downwardly on the right and left sides of the flywheel 80, and the torque frame pivots freely on the support shaft 41 of the flywheel. Because the ends 86 of the brake band 80 are affixed to the torque frame 87, frictional engagement between the brake band and the flywheel 80 rotating in the counterclockwise direction (as viewed in FIG. 5) urges the lower end of the torque frame forwardly, as indicated by the arrow 101. The push rod 102 of the torque transducer 100 receives and resists this mechanical force from the torque frame 87.

Details of the torque transducer 100 are shown in FIG. 6, although it should be understood that a conventional pressure cell or spring-loaded rheostat can be substituted for the air-operated transducer 100. The torque transducer includes a housing 105 having an internal chamber 106 containing a diaphragm 107 suspended for limited movement within the chamber. The push rod 102 is freely movable within a passage 108 at one side of the housing 105, and the inner end 109 of the push rod seats on the grommet 110 mounted in the center of the diaphragm 107. The grommet 110 has an axial passage 111 aligned with the axial bleed channel 112 in the push rod 102.

The diaphragm 107 divides the chamber 106 into two parts, with the passage 111 in the diaphragm grommet 110 being the only communication between those two parts. Contacting the grommet 110 on the side opposite the inner end 109 of the push rod is the inner end 116 of the needle valve 117. The needle valve has a main body 118 coaxial with the inner end 116 but of greater diameter, and the main body is loosely received in the channel 119 coaxial with the main body. The channel 119 is connected to a source of compressed air through the air supply line 120.

The inner end 116 of the needle valve 117 is loosely received in an inner part of the channel 119, and a cross bore 123 connects that inner channel to the air passage 124, which communicates with the right side 125 of the diaphragm chamber 106 and with the air signal line 126. The air signal line leads to a suitable air pressure transducer 127, which can be calibrated in suitable units such as foot-pounds of torque or (if associated with a timing mechanism) in power expended by the person using the exercise machine.

Considering now the operation of the exercise machine 78 shown in FIGS. 4–6, the user expends energy by pumping the treadles 22, 23, by pulling and pushing the exercise levers 54, 55, or both. This movement applies torque to rotate the flywheel 80, in opposition to the frictional drag imposed by the brake band 82 on the surface 81 of the flywheel. The extent of this frictional drag is adjusted by the knob 94, which increases or decreases the spring tension urging the torque loading pulley 85 away from the flywheel 80. As the flywheel 80 rotates, the frictional force imparted to the brake band 82 is applied to the torque frame 87 through the ends 84 and 86 of the brake band. The lower end of the torque frame 87 thus pushes against the push rod 102 of the pressure transducer 100, moving the push rod inwardly to contact the diaphragm 107 and moving that diaphragm into contact with the inner end 116 of the needle valve 117.

This mechanical movement of the needle valve 117 unseats the beveled valve surface 130 on the needle valve 117 between the main body 118 and the inner end portion 116 thereof, allowing air from the air supply line 120 to enter the right side 125 of the diaphragm chamber 106. This increased air pressure in the right side 125 acts on the diaphragm 106, urging the diaphragm toward the push rod 102 until the diaphragm force overcomes the torque-induced force on the push rod. The diaphragm 107 thus moves to the left as seen in FIG. 6. Because the right end 131 of the valve body 118 has greater cross-sectional area than the valve surface 130 of the needle valve, the increased air pressure within the needle valve chamber 119 urges the needle valve leftwardly and keeps the inner end 116 of the needle valve in contact with the diaphragm grommet 110, thereby blocking the passage 111 in the grommet. However, if the increased air pressure in the right side 125 of the chamber 106 causes diaphragm movement beyond the limited travel of the needle valve 117, determined when the valve surface 130 becomes seated, the passage 111 then opens and bleeds air pressure to atmosphere through the bleed passage 112 in the push rod 102. The transducer uses air from the supply line 120 only as needed to balance an increased force acting on the push rod 102. The force on the push rod 102 then returns the diaphragm 107 to a position where the force by the air pressure acting on the right side of the diaphragm balances the force acting on the left side thereof by the push rod 102. Because the air signal line 106 communicates with the air pressure required to produce diaphragm balance, that balancing air pressure is a measure of the torque-related force pressing the push rod 102 against the diaphragm. The balancing air pressure in the signal line 126 is thus a function of the force exerted on the exercise machine at any moment by the user. This force-related air pressure in the signal line 126 is displayed by the output device 127, which as mentioned previously may be calibrated in work- or power-related terms meaningful to the user.

Figures 7, 8:
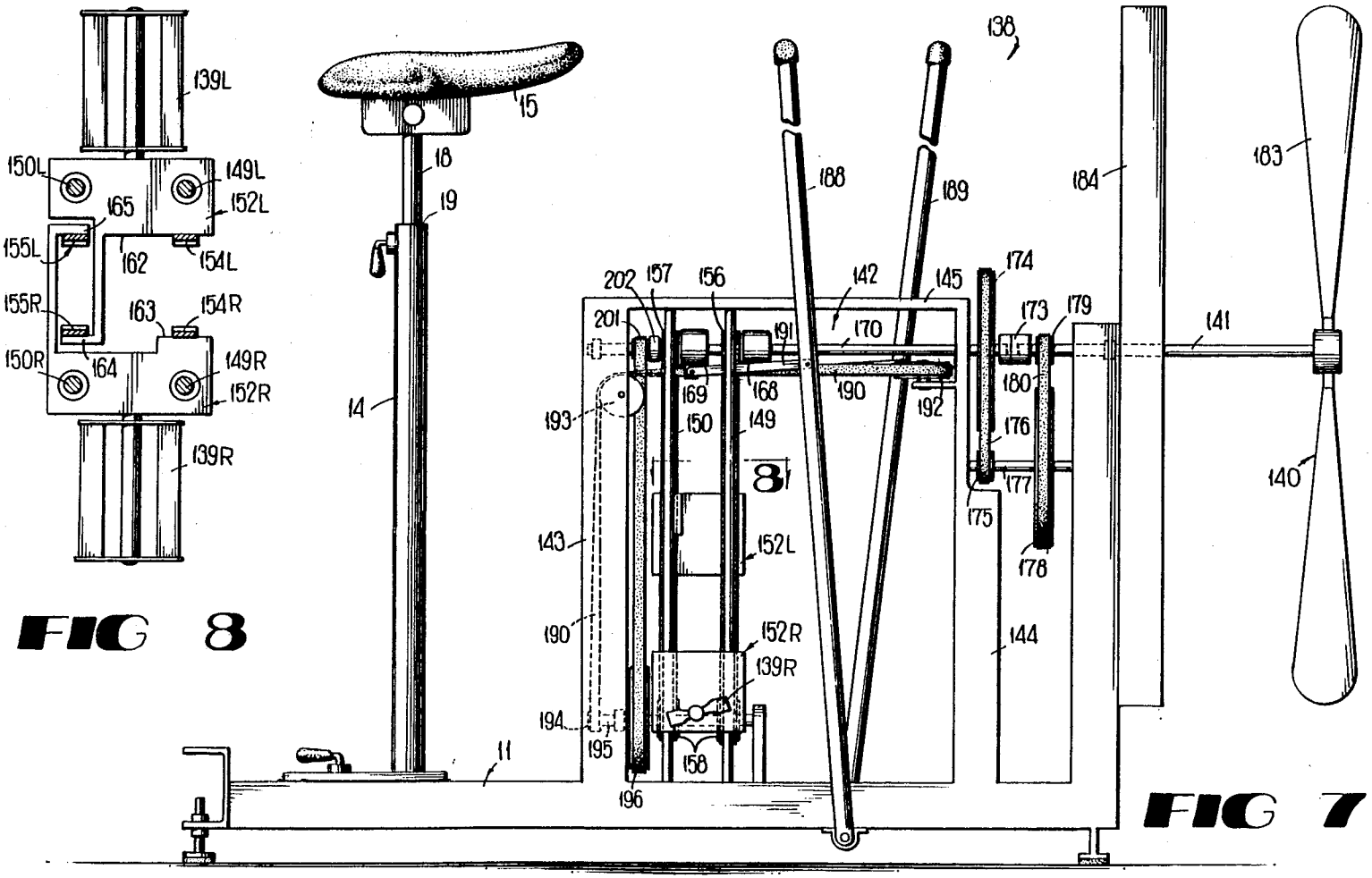
FIG. 7 is a side elevation view showing a third embodiment of the present invention.
FIG. 8 is a section view taken along line 8—8 in FIG. 7.
Figure 9:
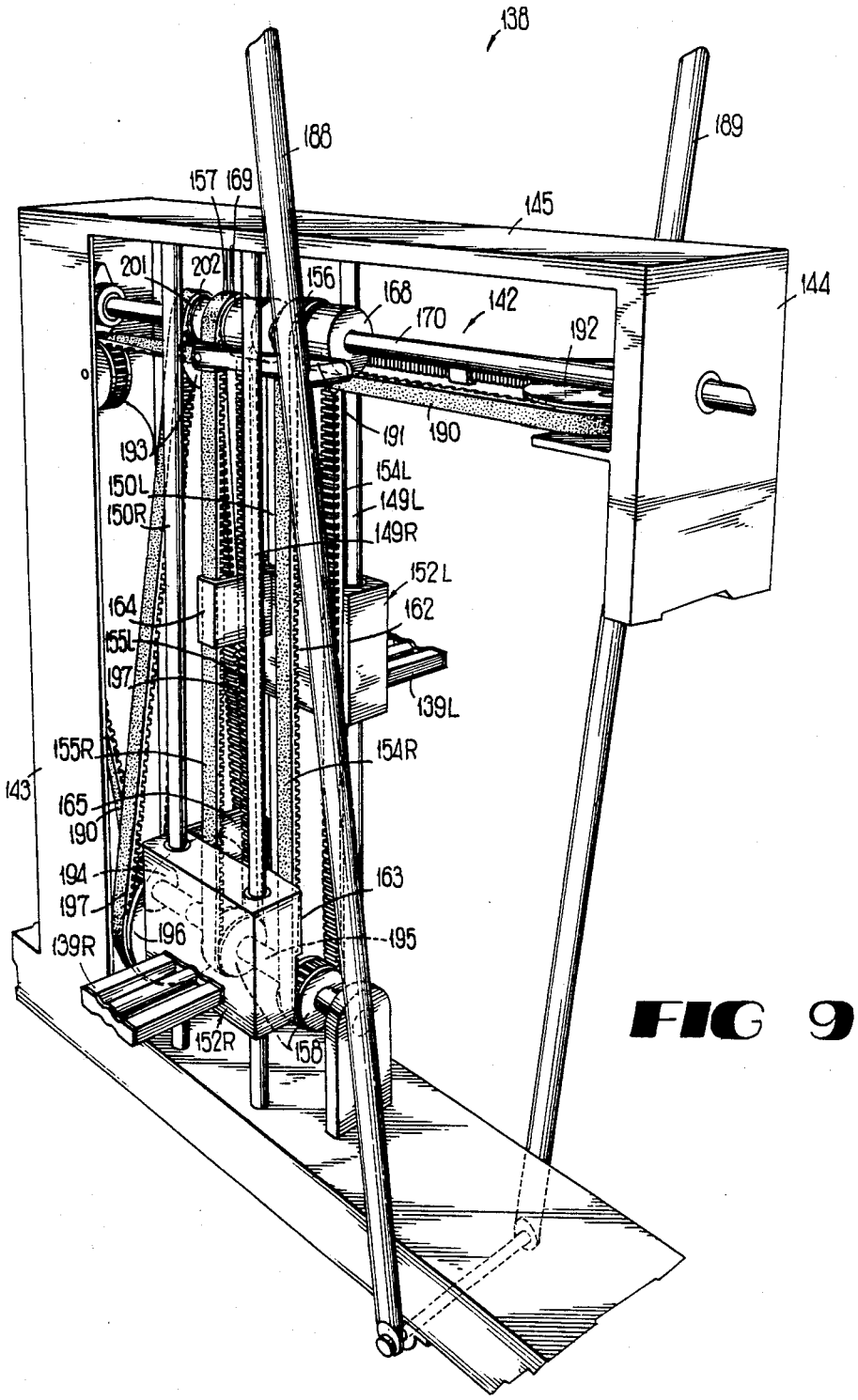
FIG. 9 is a fragmentary pictorial view showing the drive mechanism of the embodiment in FIGS. 7 and 8.

FIGS. 7–9 show an exercise machine 138 according to a third disclosed embodiment of the present invention. The exercise machine 138 includes a base 11 mounting a seat support 14 with a seat 15 thereon, as in the preceding embodiments. However, the exercise machine 138 lacks the foot treadles of the preceding embodiments, substituting pedals constrained to slide back and forth along a defined path, in response to foot pressure. As with the treadle operation of the preceding embodiment, the pedals of the exercise machine 138 permit the user to exert work-producing force uniformly along the entire pedal stroke. The right-side pedal for the present machine is shown at 139R.

The exercise machine 138 uses a fan 140 mounted on the longitudinal fan shaft 141 as a load against which the person using the machine does work. The fan shaft 141 is supported at the front end of a drive mechanism indicated generally at 142, and including the upright posts 143 and 144 spaced longitudinally apart from each other along the base 11. A top bar 145 extends between the upper ends of the posts 143 and 144. Suitable side panels are normally mounted on the posts 143, 144 and the top bar 145 to conceal the moving parts within the drive mechanism, but those panels are missing from FIG. 7 for illustrative purposes.

A pair of laterally-spaced front slide bars extends vertically down from the top bar 145 to the base 11, and are positively fixed in place at both upper and lower ends. Only the right front slide bar 149R is visible in FIG. 7, the left front slide bar 149L appearing in FIG. 9. A pair of rear slide bars 150R and 150L also extends between the top bar 145 and the base 11 on a vertical path. The spacing of these front and rear slide bars is best seen in FIG. 8. Mounted on the front slide bars 149R, 149L and the rear slide bars 150R, 150L are the right pedal block 152R and the left pedal block 152L. The pedal blocks 152R and 152L are slidably mounted on the slide bars by ball bushings of conventional design, so that the pedal blocks are free to reciprocate up and down the slide bars with minimal frictional resistance to sliding.

A front drive belt 154 and a rear drive belt 155 are mounted between the pedal blocks 152R and 152L, and are connected to the pedal blocks. The drive belts 154 and 155 preferably are toothed belts as described above, and these belts engage the respective toothed pulleys 156 and 157 near the upper end of the drive mechanism 142. The drive belts 154 and 155 also pass over the optional idler pulleys collectively indicated 158, mounted near the lower end of the drive mechanism 142 and helping maintain the drive belts taut; these idler pulleys may be omitted, as the pedal block interconnection maintains the proper movement of the drive belts.

FIG. 8 details the attachments of the front and rear drive belts to the pedal blocks 152R and 152L. The left side 154L of the front drive belt is attached to the inner side 162 of the left pedal block 152L. The right side 154R of the front drive belt is attached to the inner side 163 of the right pedal block 152R. Downward movement of the right pedal 139R, for example, thus moves downwardly the right side 154R of the front drive belt 154 and concurrently raises the left side 154L of that drive belt, thereby raising the left pedal block 152L and its associated pedal 139L.

The pedal blocks 152L and 152R each have extensions disposed along the respective opposite sides of the rear drive belt 155. Thus, the left pedal block 152L has an extension 164 secured to the right side 155R of the rear drive belt. The right pedal block 152R likewise has an extension 165 secured to the left side 155L of the rear drive belt. It should now be apparent that depressing one pedal, for example, pedal 139L, not only moves the front drive belt 154 to raise the right pedal 139R as previously described, but also moves the rear drive belt 155 in the direction opposite that of the front drive belt. This movement of the rear drive belt 155 is, in turn, coupled to the right pedal 139R through the extension 155L and the right pedal block 152R.

The upper pulleys 156 and 157, engaged by the front drive belt 154 and the rear drive belt 155, connect to the inputs of the respective one-way clutches 168 and 169. The outputs of both clutches 168 and 169 are connected to the main shaft 170, which extends longitudinally along the upper end of the drive mechanism 142. The two one-way clutches 168, 169 drive the main shaft 170 in response to input rotation in the same direction, clockwise (as viewed looking forwardly) in the disclosed embodiment. Thus, pressing the right pedal 139R downwardly pulls the right side 154R of the front drive belt 154, rotating clockwise the pulley 156 connected to the forward clutch 168. This clockwise movement is imparted to the main shaft 170. As the right pedal 139R moves downwardly, the left pedal 139L moves upwardly and the rear drive belt 155 moves in the opposite direction, rotating counterclockwise the rear drive pulley 157. The rear one-way clutch 169 freewheels in response to this counterclockwise movement, which does not affect the clockwise rotation of the main shaft 170. When the right pedal 139R reaches the bottom of its movement and the user presses downwardly on the now-raised left pedal 139L, the extension 164 of the rear pedal moves downwardly the right side 155R of the rear drive belt, imparting clockwise rotation to the rear drive pulley 157, and operating the rear one-way clutch 169 to turn the main shaft 170 clockwise. Each downward stroke of the pedals 139R, 139L thus drives the main shaft 170 in the same direction.

The main shaft 170 is supported by bearings within the drive mechanism 142. The forward end of the main shaft 170 extends forwardly of the front post 144, terminating within the coupling 173. This coupling 173 contains a bearing in which the main shaft 170 freely rotates; the coupling does not transmit rotation of the main shaft. Immediately behind the coupling 173, the main shaft 170 connects to a large pulley 174 driving a relatively smaller pulley 175 through the drive belt 176. The smaller pulley 175, in turn, drives the jack shaft 177 to rotate the relatively large pulley 178, which in turn drives a relatively smaller pulley 179 through the belt 180. The pulley sets 174, 175 and 178, 179 each have a 5:1 step-up ratio in a specific embodiment of the present invention, although that ratio is not considered critical.

The pulley 179 drives the previously-identified fan shaft 141 to rotate the fan 140. The fan shaft 141 is coaxial with the main shaft 170, and the back end of the fan shaft is supported within the coupling 173. The blades 183 of the fan 140 may be fixed or adjustably pitched to vary the air resistance of the rotating fan, and to direct the air flow rearwardly toward the user of the machine if desired. The frame 184, located on the exercise machine 138 behind the fan 140, holds adjustable louvers or vanes to limit air flow toward the user as desired.

The exercise machine 142 also includes handles 188 and 189 that the user can grasp and manipulate, either while working the pedals or independently of the pedals. The lower ends of these handles are pivoted at the frame 11, as with the corresponding handles of the previously-described embodiments. Each handle 188, 189 is connected to a toothed belt 190 by separate rigid drive links, one of which is shown at 191. The belt 190 passes over an idler pulley 192 mounted in a horizontal plane near the upper end of the front post 144, extending rearwardly in a substantially horizontal plane to the rear idler pulleys collectively designated 193, mounted at the rear post 143 on vertical planes at either side of the drive mechanism 142. The belt 190 proceeds downwardly from the rear idler pulleys 193, passing over the pulley 194 connected to the shaft 195 rotatably mounted near the lower end of the rear post 143. The shaft 195 drives a relatively large pulley 196 supporting a belt 197, extending upwardly to the relatively small pulley 201 connected to the sleeve 202 extending back from the input side of the rear one-way clutch 169. The main shaft 170 extends within the sleeve 202 and the pulley 201 without interfering with rotation of the pulley.

The operation of the handles 188, 189 should now become apparent. As the user reciprocates the handles 188, 189 back and forth, the links 191 couple that movement to the belt 190 and, through the step-up drive provided by the pulleys 194, 196, and 201, to the input of the clutch 169. Every full reciprocation of the handles 188, 189 is thus transmitted through the one-way clutch 169 to do work on the fan 140.

Figure 10:
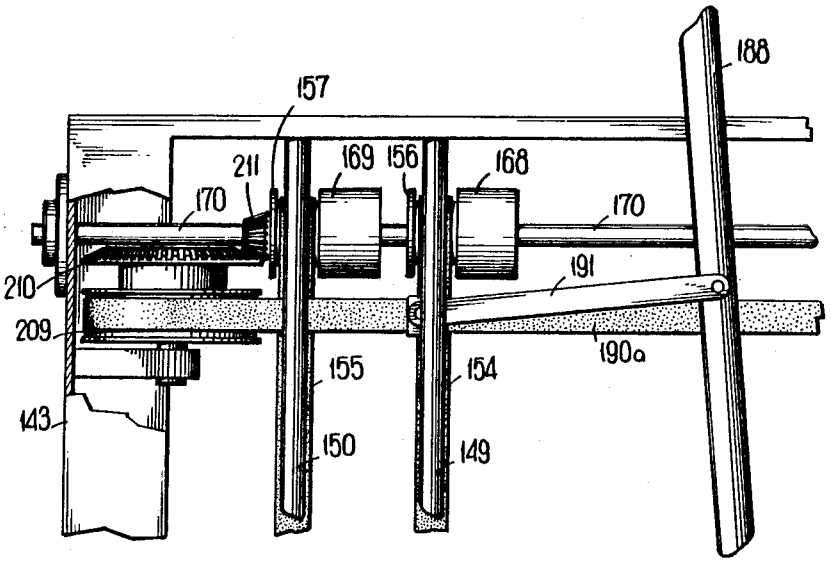
FIG. 10 is a fragmentary side elevation view showing an alternative drive arrangement for the embodiment of FIGS. 7–9.

FIG. 10 shows an alternative arrangement for coupling movement of the handles 188, 189 to rotate the main shaft 170. This alternative arrangement avoids a drive belt 190 operating in several planes, and substitutes the drive belt **190*a* extending rearwardly to engage the pulley 209 mounted in the horizontal plane on the rear post 143. The pulley 209 is connected to the bevel gear 210 facing upwardly to the main shaft 170. The bevel gear 210 meshes with a second and relatively smaller bevel gear 211, connected to the input side of the rear one-way clutch 169, immediately behind the pulley 157 associated with that clutch. The relative diameters of the two bevel gears 210, 211 are chosen to provide the desired speed step-up ratio between the handles 188, 189 and the main shaft 170** driving the fan.

Figure 13:
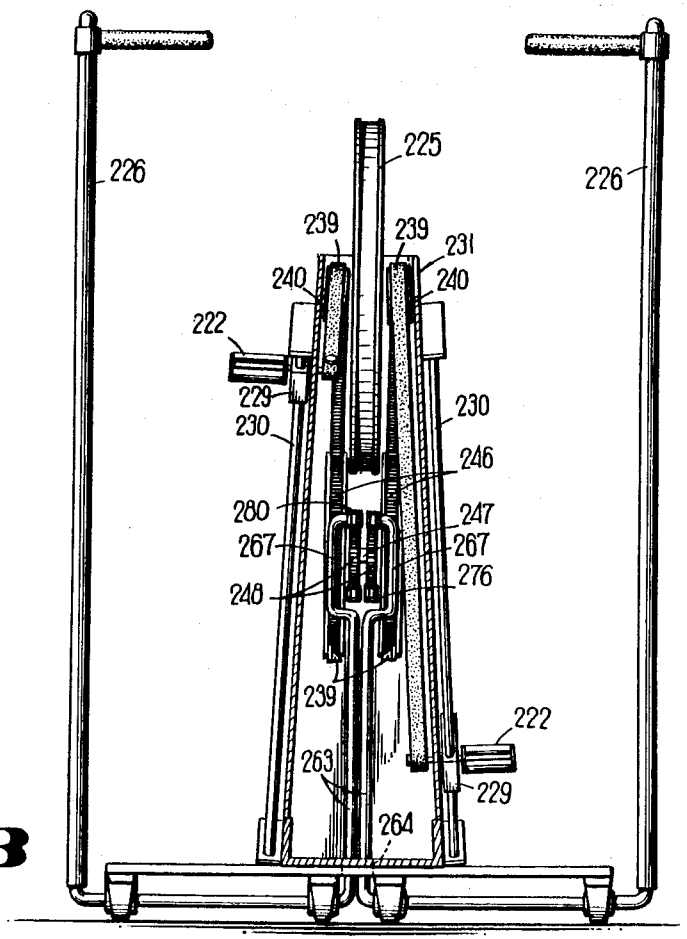
FIG. 13 is a section view taken on line 13—13 of FIG. 11, with some elements omitted for clarity.
Figure 11:
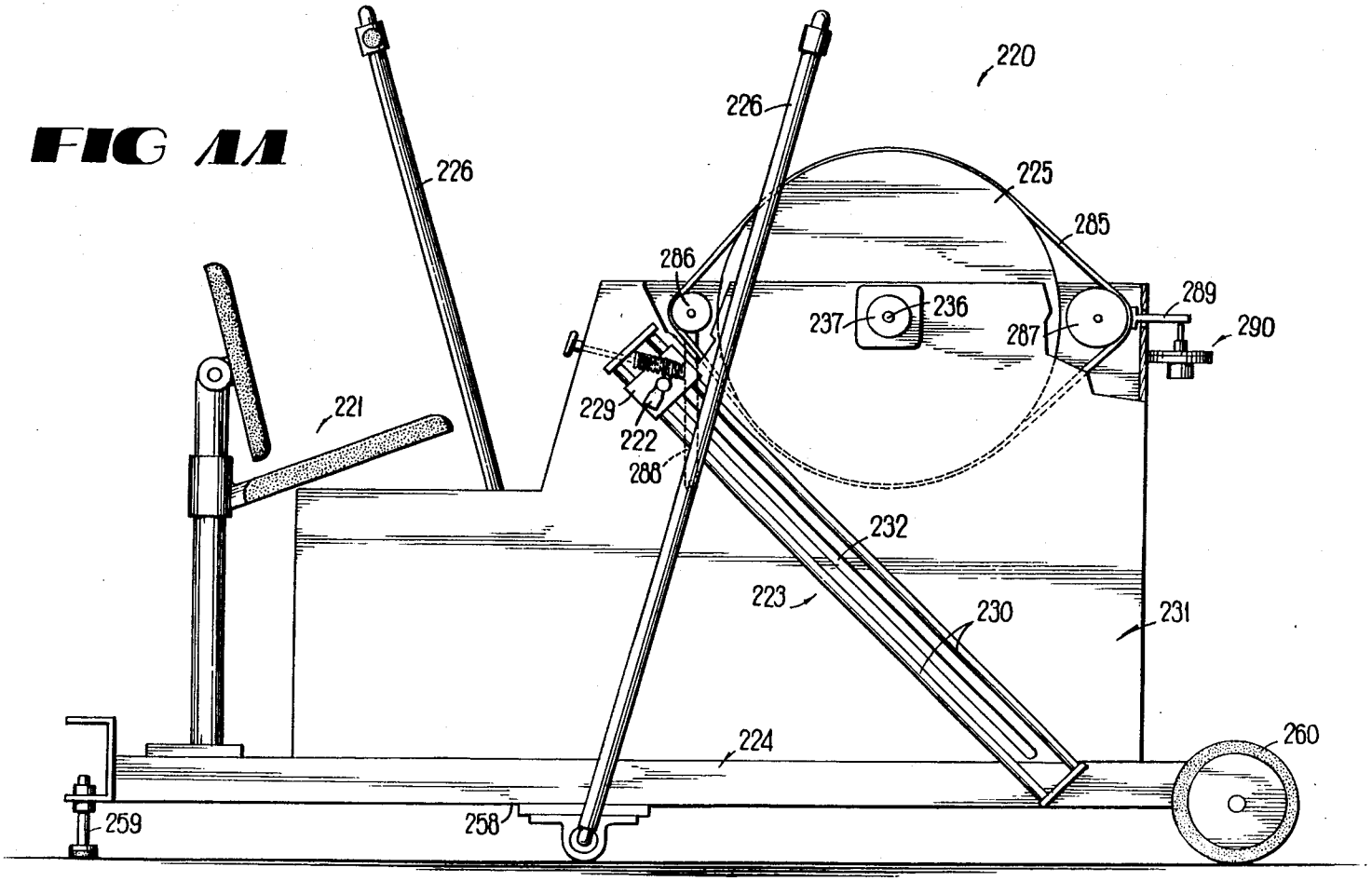
FIG. 11 is a side elevation view, partially broken away for illustration, showing a fourth embodiment of the present invention.
Figure 12:
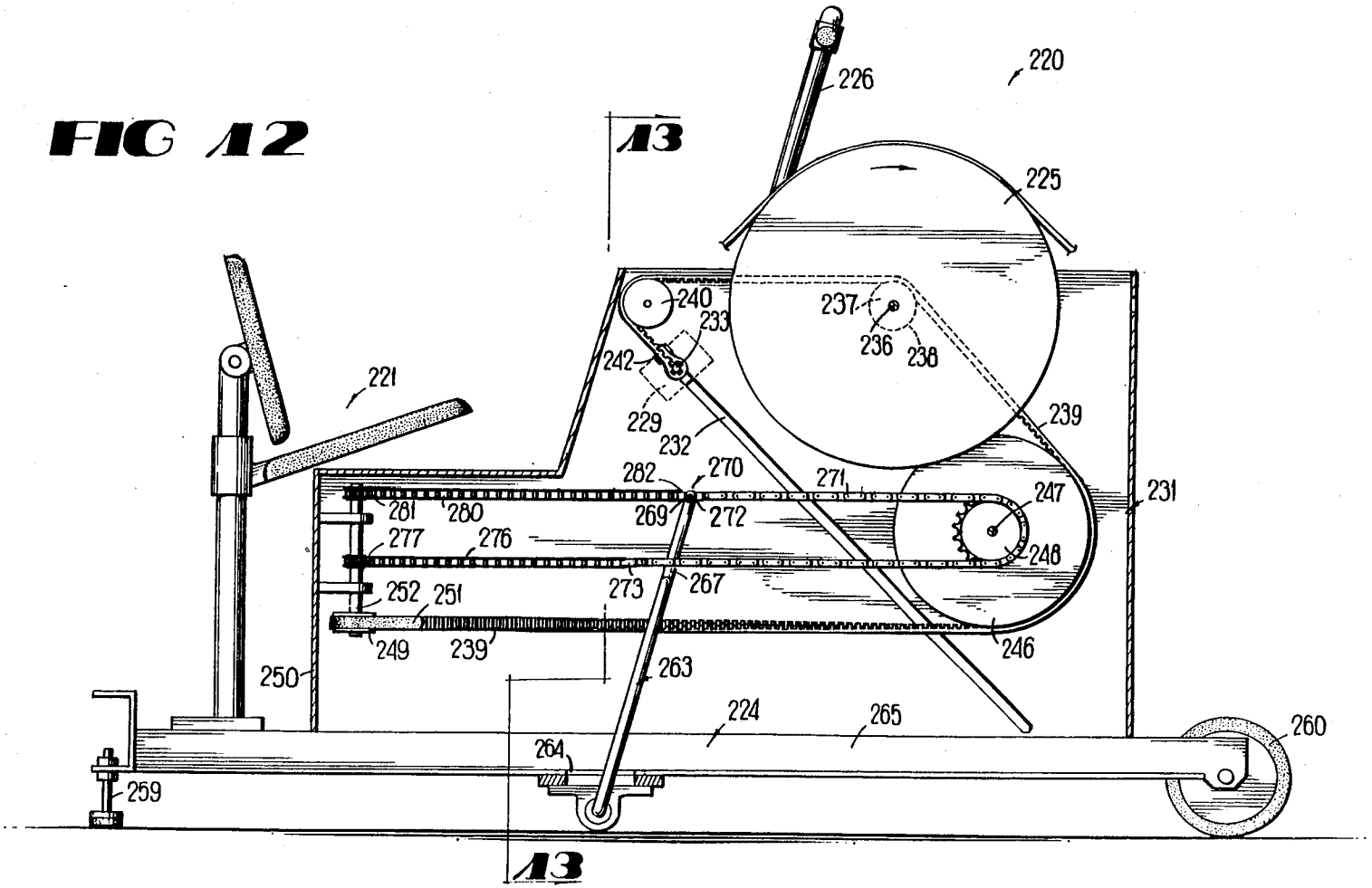
FIG. 12 is a sectioned side elevation view of the embodiment shown in FIG. 11.

FIGS. 11–13 show an exercise machine 220 according to a fourth embodiment of the present invention. The exercise machine 220 includes a seat 221 preferably designed to support a user's body in partially reclining attitude, and foot pedals 222 (only one of which is visible in FIG. 11) supported for reciprocation along a path 223 diagonal relative to the base 224 of the exercise machine. The pedals are connected to drive the flywheel 225, and the two exercise handles 226 are also coupled to drive the flywheel. For safety reasons, it should be understood that the flywheel 225 is contained within a suitable protective device such as a shroud or the like, not shown in FIG. 11. The reclining-seat position of the exercise machine 220, together with the angled path 223 of reciprocation for the pedals 222, allows pedaling with force greater than the user's body weight alone can produce, and thereby increases the maximum rate of work a person can expend with this exercise machine.

A slide block 229 supports the pedal 222 on the right side of the exercise machine, and the slide block travels along a pair of rails 230 mounted on the outside of the housing 231 containing the drive mechanism coupling movement of the pedals and exercise handles to the flywheel 225. An elongated slot 232 extends through the housing 231 in parallel alignment with the rails 230, and a post (the post for the left side is shown in FIG. 12 at 233) is attached to the slide block 229 and extends through the slot into the interior of the housing 231. It should be understood that the pedal assembly including rails 230 and slot 232 are duplicated on the left side of the exercise machine 220, and those elements are denoted by common reference numerals in the present embodiment. The post 233 for the slide block on the left side of the exercise machine 220 appears in FIG. 12 and is explained in more detail below.

Details of the drive mechanism for the exercise machine 220 are shown in FIGS. 12 and 13. The flywheel 225 is supported on the flywheel axle 236, and a pair of one-way clutches 237 are connected to drive the flywheel 225 in one direction, the one-way clutches being located on both sides of the flywheel. The input of each clutch 237 includes a pulley 238 engaged by the toothed belt 239. One end of the belt 239 extends rearwardly from the pulley 238 on the left side of the flywheel 225, passes over the grooved pulley 240 at the left rear side of the housing 231, and extends downwardly to terminate at the belt end 242 secured to the previously-mentioned post 233 extending within the slot 232 from the pedal slide block 229 on the left side of the housing 231. The left-side pedal block 229 is near the upper end of its diagonal stroke, in FIG. 12.

The belt 239 extends forwardly and downwardly from the pulley 238 on the one-way clutch, passing around the grooved timing belt pulley 246 mounted on the shaft 247, within the housing 231 and below and somewhat to the left of the flywheel 225. A chain sprocket 248, also freely rotatable on the shaft 247, is attached to the timing belt pulley 246. It will be understood that the timing belt pulley 246 and the chain sprocket 248 shown in FIG. 12 are one of two such pulley-sprocket sets, the other set (not shown in FIG. 12) being coaxially mounted on the shaft 247 on the right side of the flywheel 225.

The timing belt 239, after traversing approximately 120° of the timing belt pulley 246, moves rearwardly toward the idler pulley 249, making a quarter-twist on the way. The idler pulley 249 is mounted on a vertical axis, near the back side 250 of the housing. The timing belt 239 wraps around the idler pulley 249, and extends forwardly from that pulley at 251, making another quarter-twist before reaching the right-side timing belt pulley, not shown. The belt 239 passes around the right-side timing belt pulley and travels upwardly to engage the pulley 238 of the one-way clutch 237 on the right side of the flywheel 225. The belt 239 then moves rearwardly, passing over the right-side idler pulley 240 and terminating at the other end connected to the post 233 associated with the pedal block on the right side of the exercise machine 220. It should now be apparent that depressing one of the pedals 222 raises the other such pedal, and vice versa, through the belt 239 interconnecting the pedals.

The rails 230 and the pulley 240 on each side are canted outwardly a few degrees from vertical, FIG. 13, so that the posts 233 miss striking the belt 239 as the pedal slide blocks 229 reciprocate.

The two exercise handles 226 extend downwardly along the left and right sides of the housing 231, as best seen in FIG. 13. The exercise handles are journalled beneath the base 258 of the exercise machine, which is supported above a floor surface by the adjustable support 259 (FIG. 12) at the back of the base and by the wheels 260 at the front end thereof. Each exercise handle 226 includes a lever 263 extending upwardly through a slot 264 in the longitudinal U-shaped channel member 265 centrally located within the housing 231. The lever 263 of each exercise handle extends upwardly a distance within the housing, joggling outwardly at 267 and then terminating at the inwardly-facing end 269 (FIG. 12) which engages the chain connectors 270. A first length of roller chain 271 attaches to the front end 272 of the chain connector 270, and extends forwardly to pass around the left-side chain sprocket 248, attached to the left-side timing belt pulley 246. The roller chain 271 continues rearwardly from the bottom of the sprocket 248, terminating at the chain connector 273. A second roller chain 276 is attached to the back end of the chain connector 273, rotated 90° with respect to the roller chain 271. The roller chain 276 extends rearwardly from the connector 273, passing over the idler sprocket 277 freely rotating on the shaft 252 near the back of the housing. The second roller chain 276 passes around the idler sprocket 277, extending forwardly for functional engagement with the chain sprocket 248 associated with the right side sprocket-timing belt pulley combination rotatably mounted on the shaft 247. It should now be apparent that the right side of the timing chain drive includes a third roller chain analogous to the chain 271, and connecting through another chain connector to the fourth roller chain. That fourth roller chain, in turn, passes around the idler sprocket 281 mounted for free rotation on the shaft 252, and thence extends forwardly for attachment to the back end 282 of the chain connector 270. The several chain connectors 270, 273 . . . are required for 90° rotation of the roller chains between the vertical drive sprockets 248 and the horizontal idler sprockets 277, 281. The idler chains pass between the levers 263 of the exercise handles, in the space provided by the joggles 267, FIG. 13.

Variable-resistance loading is imparted to the flywheel 225 through the belt 285, FIG. 11. This belt 285 fits within the flanged periphery of the flywheel 225, engaging the upper and lower portions of the flywheel and extending outwardly to pass around the rear tension pulley 286 and the front tension pulley 287, both mounted within the housing 231. The rear tension pulley 286 is supported at the end of a spring-biased lever 288 adjustable to vary the tension on the belt 285, and thus the frictional drag imparted to the flywheel 225 by the belt. The front tension pulley 287 is freely rotatable on its axis, but a force arm 289 attaches to the pulley and optionally to the belt 285, and extends outwardly to contact the operating plunger of the force transducer 290. The transducer 290 operates in the manner previously described to restrict movement of the force arm 289, thereby restricting rotation of the front tension pulley 287.

Operation of the embodiment shown in FIGS. 11–13 should now be apparent. As a person sitting on the seat 221 works the pedals 222 back and forth, the reciprocating motion of the belt 239 acts through the one-way clutches 237 to rotate the flywheel 225 in a predetermined direction. The friction belt 285 resists rotation of the flywheel 225, and the force transducer 290 measures the amount of work expended by the exerciser in the manner previously described. The pedals 222 are interconnected with the exercise handles 226 through the timing belt pulleys 246 and drive sprockets 248, allowing the exerciser to use either the exercise handles 226 or the pedals 222, or both, in driving the flywheel 225. The present embodiment, as is the case with the previously-described embodiments, can be equipped with suitable electronic displays to indicate desirable parameters, for example, such as power expended, "distance" traveled, or other variables.

Specific components described above as elements of particular disclosed embodiments of the invention may also be used in other embodiments where appropriate. For example, the seat of the embodiment shown in FIGS. 11–13 can substitute for the seats of other embodiments. Other appropriate substitutions will appear to those skilled in the art.

It should also be understood that the present drive mechanism are not limited to stationary exercise machines, and can replace the conventional rotary crank pedal mechanism for propelling bicycles or other vehicles.

It should be apparent that the foregoing refers only to the disclosed embodiments of the present invention, and that numerous changes and modifications may be made therein without departing from the spirit and scope of the following claims.

I claim:

1. An exercise machine comprising:

a rotatable device for dissipating energy;

a pair of foot treadles pivotally mounted in predetermined relation to said rotatable device and operatively interconnected for alternating reciprocable movement causing movement of each foot treadle in a first direction in response to movement of the other foot treadle in a second direction, and vice versa;

means operatively interconnecting said foot treadles to impart continuous rotary motion to said rotatable device in response to alternate reciprocation of the foot treadles by a user of the exercise machine;

a pair of hand levers mounted in predetermined relation to said rotatable device and operatively interconnected for alternating reciprocal movement causing movement of each hand lever in a first direction in response to movement of the other hand lever in a second direction by the user, and vice versa;

means operatively interconnecting said hand levers to impart continuous rotary motion to said rotatable device in response to alternate reciprocation of the hand levers by the user, so that the user can expend energy in driving the rotatable device by using feet or hands, or both feet and hands;

said operative interconnection between the hand levers comprising a flexible link connected with both said hand levers and passing over a pulley which reverses the direction of the flexible link, so that one hand lever is moved in a direction toward the user when the other hand lever is moved in a direction away from the user, and vice versa;

said operative interconnection between the foot treadles comprising a flexible link connected with both said foot treadles and passing over a pulley which reverses the direction of the flexible link, so that one foot treadle is raised by the last-mentioned flexible link when the other foot treadle is depressed by the user, and vice versa; and means operatively interconnecting the foot treadles with the hand levers so that reciprocation of either treadle causes reciprocation of both hand levers, and vice versa, whereby the energy expended by the user in alternately reciprocating the foot treadles or the hand levers drives the rotary device at a substantially constant rate throughout the movement of each foot treadle or hand lever and is there dissipated.

2. An exercise machine comprising:

a rotatable device for dissipating energy;

a seat mounted in predetermined relation to said rotatable device and supporting a user of the exercise machine;

a first pair of levers pivotally mounted in predetermined relation to said seat and operative for a certain maximum extent of reciprocable movement in one direction or in the opposite direction by a user of the exercise machine;

a second pair of levers pivotally mounted in predetermined relation to said seat and operative for a certain maximum extent of reciprocable movement in one direction or the opposite direction by a user of the exercise machine;

one-way clutch means driven alternately in said two directions by reciprocal movement of said first pair of levers, and transmitting energy to drive the rotatable device in one direction only;

means connecting said second pair of levers to said one-way clutch means for transmitting energy to drive the rotatable device in response only to movement of the second pair of levers in one direction; and means operatively interconnecting the first pair of levers with the second pair of levers so that movement of either lever in the first pair causes movement of the second pair; and vice versa, so that the user of the exercise machine can do work on the rotatable means by moving either lever in one direction along at least part of said maximum extent, and can move that lever in the other direction without interference from the rotatable device.

3. An exercise machine as claim 1, further comprising:

means operatively interconnecting said foot treadles for movement in unison with said hand levers, so that one hand lever moves toward the user and the other hand lever moves away from the user when a certain foot treadle is depressed, and vice versa.

* * * * *